US006386589B1

(12) United States Patent
Yuh

(10) Patent No.: US 6,386,589 B1
(45) Date of Patent: May 14, 2002

(54) CLIPBOARD

(76) Inventor: Su Shyi Yuh, P.O. Box 487, Chang-Hua City (TW), 500

( * ) Notice: Subject to any disclaimer, the term of this patent is extended or adjusted under 35 U.S.C. 154(b) by 0 days.

(21) Appl. No.: 09/925,480

(22) Filed: Aug. 10, 2001

(51) Int. Cl.[7] ..... B42D 17/00

(52) U.S. Cl. ..... 281/45; 248/444.1; 281/21.1; 281/15.1

(58) Field of Search ..... 281/15.1, 21.1, 281/42, 45, 51; 248/444.1, 451; 24/67 R

(56) References Cited

U.S. PATENT DOCUMENTS 4,948,172 A * 8/1990 Chong ..... 281/45
5,046,760 A * 9/1991 Krepp ..... 281/45
5,897,934 A * 4/1999 Yeh ..... 281/45
6,217,075 B1 * 4/2001 Tsai ..... 281/45

* cited by examiner

*Primary Examiner*—Willmon Fridie, Jr.

(57) ABSTRACT

A clipboard comprises a clip mechanism comprising a body having two spaced protuberant members, a flexible plate member, two U-shaped fastening members for fastening body and plate member for being capable of holding papers, and a retractable hanging device, and a board mechanism comprising four bottom channels for securing to clip mechanism, and a recessed portion surrounded by channels. In an unused state hanging device is retracted while in a use state hanging device is extended for being capable of banging object. A space is formed between spoon-like members and recessed portion for holding an elongate object such as a pen.

4 Claims, 7 Drawing Sheets

CLIPBOARD

FIELD OF THE INVENTION

The present invention relates to clipboards and more particularly to such a clipboard with improved characteristics.

BACKGROUND OF THE INVENTION

A conventional clipboard has a spring biased clip for holding papers. The drawback of such clip is that spring tends to lose its elasticity after a long time of use. This may shorten a useful life of the clipboard. Moreover, there is no provision of means for holding a pen or the like in other well known clipboards. Thus, it is desirable to provide an improved clipboard which is durable in addition to a provision of means for holding a pen or the like.

SUMMARY OF THE INVENTION

It is an object of the present invention to provide a clipboard comprising: a clip mechanism comprising a body having two spaced protrusions, two projected members each on the protrusion, two spaced spoon-like members projected from a side, a bent brace on a top, two spaced protuberant members on both sides of the brace, two first grooves each on the protuberant member, two second grooves each under the protuberant member, a projection between the spoon-like members and under the body, two spaced elongate recesses on both sides of the projections, and two ridges each on the recess; a flexible plate member including two spaced projected members on an underside and two third grooves each under the projected member; two U-shaped fastening members each having two hooked ends clung into the third groove and second grooves for fastening the body and the plate member for being capable of holding papers; and a retractable hanging device having a J cross-section and comprising an elongate slot on a bottom, two spaced risers adjacent the slot, two first dents each on the riser, and an opening between the risers; and a board mechanism comprising four channels on a bottom each parallel to a side, each channel having a plurality of equally spaced second dents, and a recessed portion surrounded by the channels; wherein the hanging device is mounted onto the body with the projection movably received in the opening and the risers received in the recesses.

In one aspect of the present invention, in an unused state the hanging device is retracted. to engage with the brace, and in a use state, the hanging device is extended to move a maximum distance equal to a difference between a length of the projection and that of the opening, the ridges are received in the first dents, and the slot is exposed.

In another aspect of the present invention, the protrusions are inserted into the channels on one of the sides of the board mechanism with the projected members received in the second dents.

In still another aspect of the present invention, a space is formed between the spoon-like members and the recessed portion for holding an elongate object such as a pen.

The above and other objects, features and advantages of the present invention will become apparent from the following detailed description taken with the accompanying drawings.

DETAILED DESCRIPTION OF THE PREFERRED EMBODIMENTS

Figure 1:
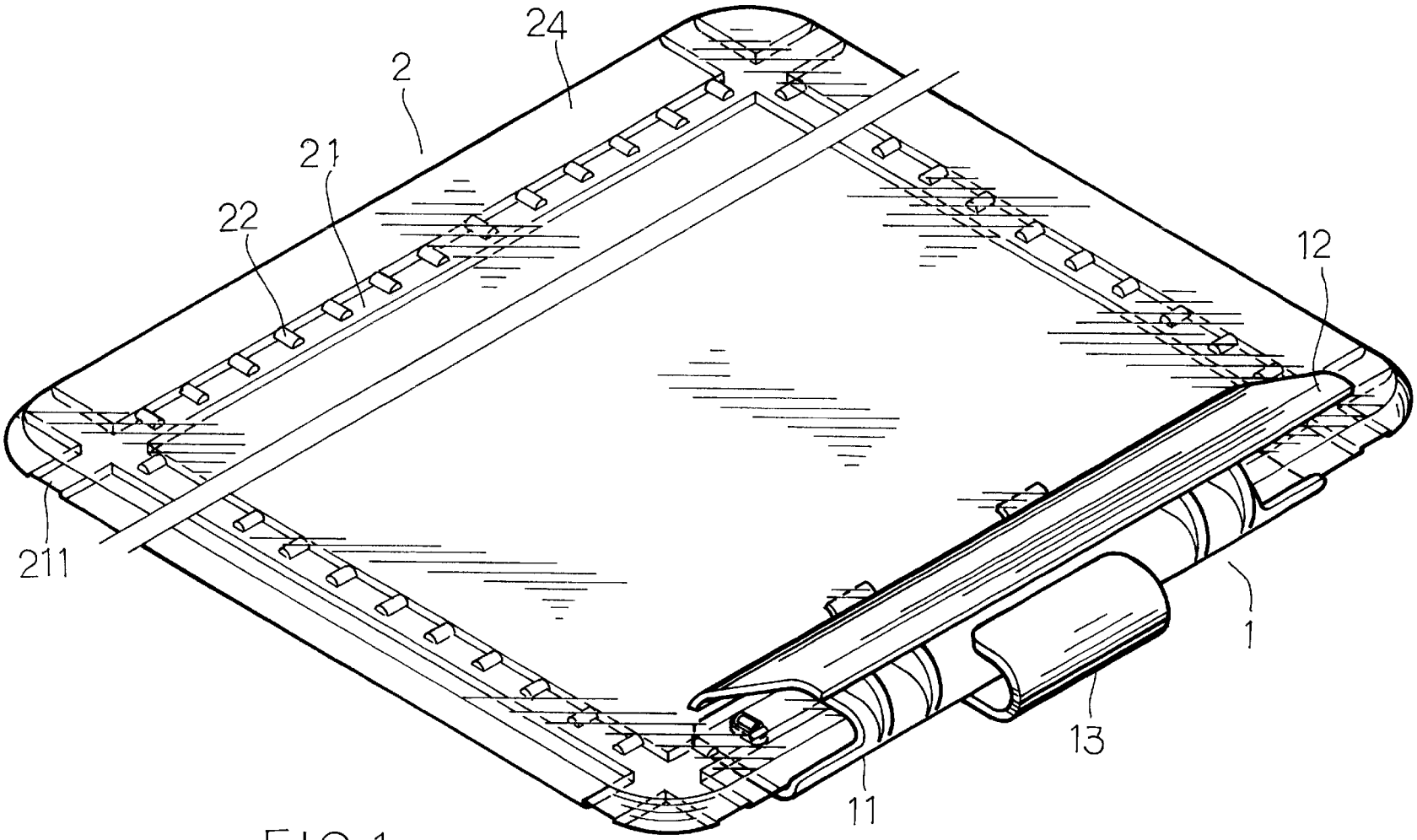
FIG. 1 is a perspective view of a preferred embodiment of clipboard according to the invention.
Figure 2:
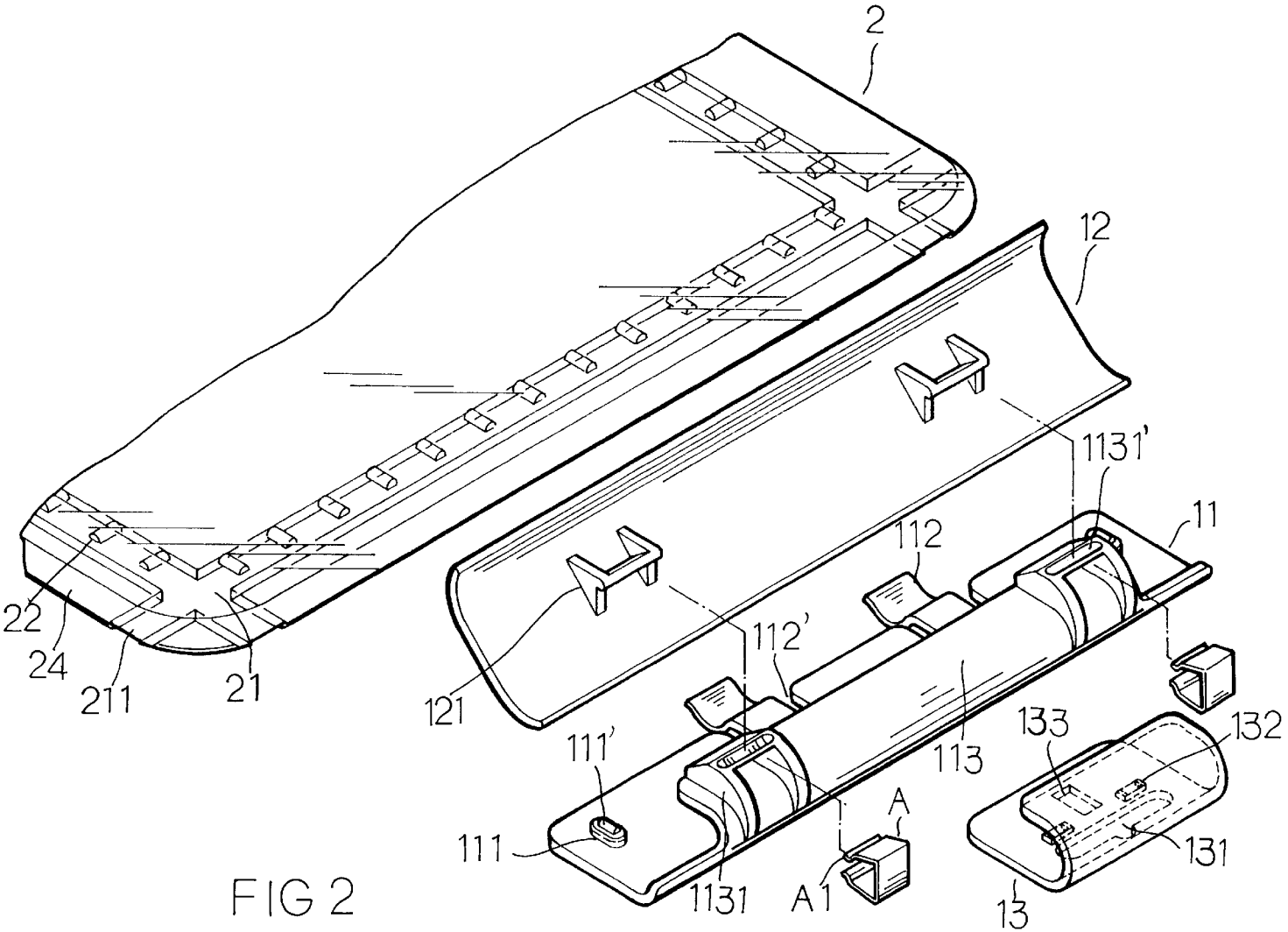
FIG. 2 is an exploded view of FIG. 1.
Figure 3:
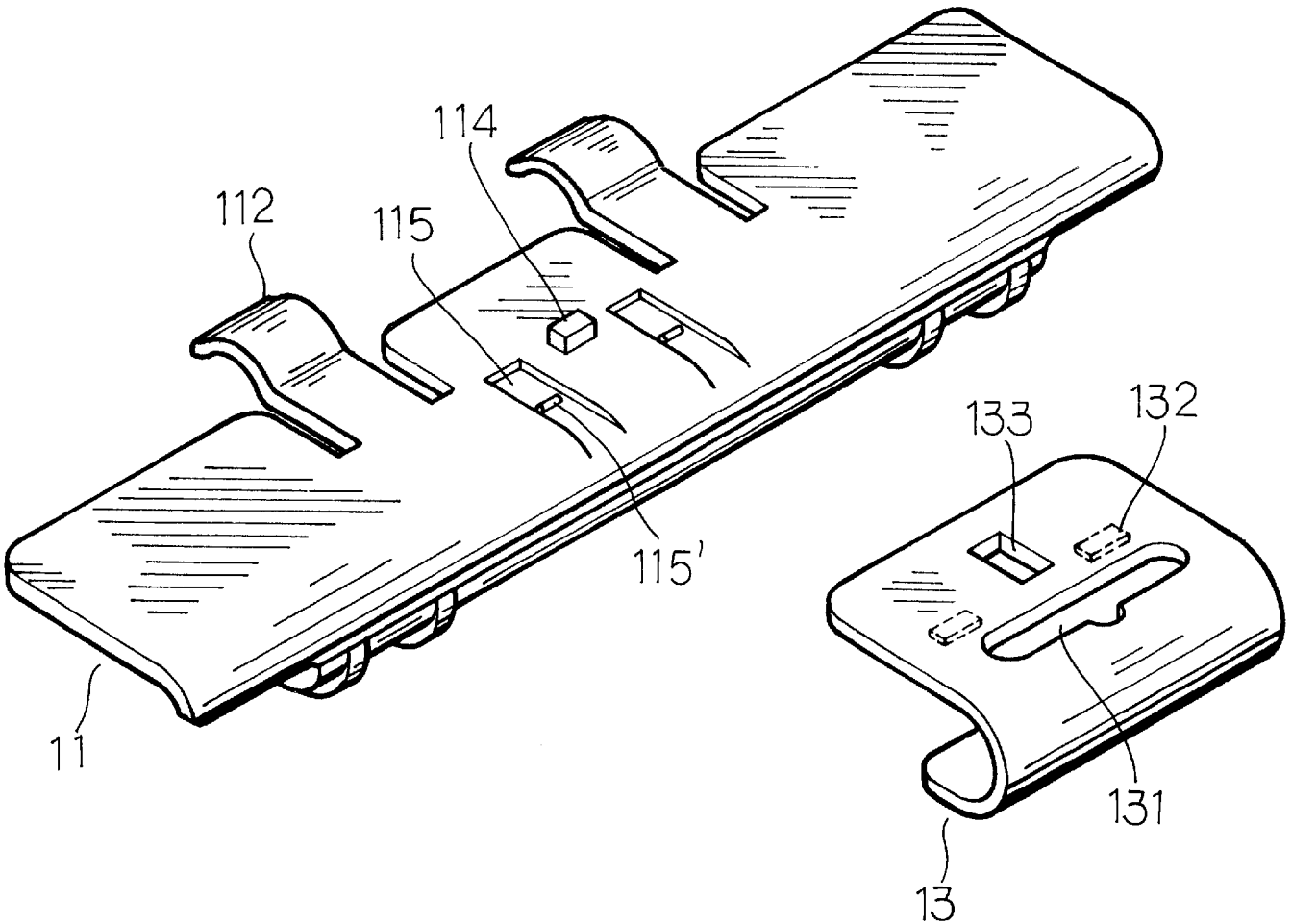
FIG. 3 is a bottom perspective view of body and hanging device of FIG. 1.
Figure 4:
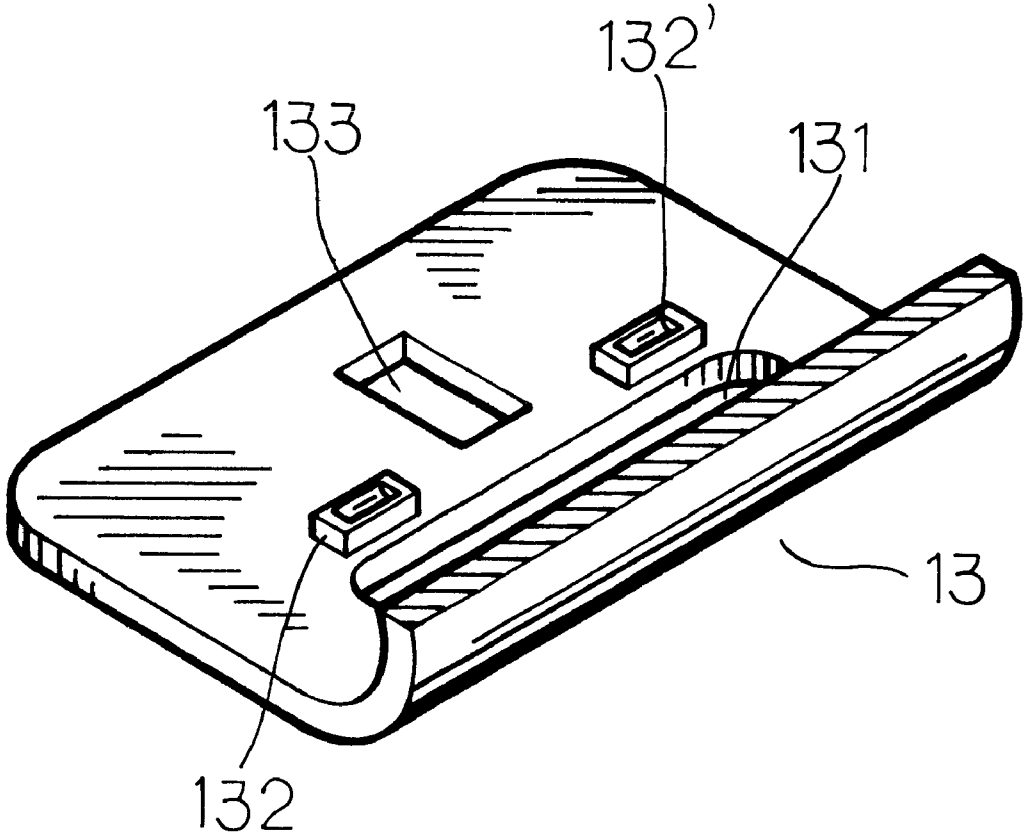
FIG. 4 is a perspective view of hanging device with a portion cut away.
Figure 5:
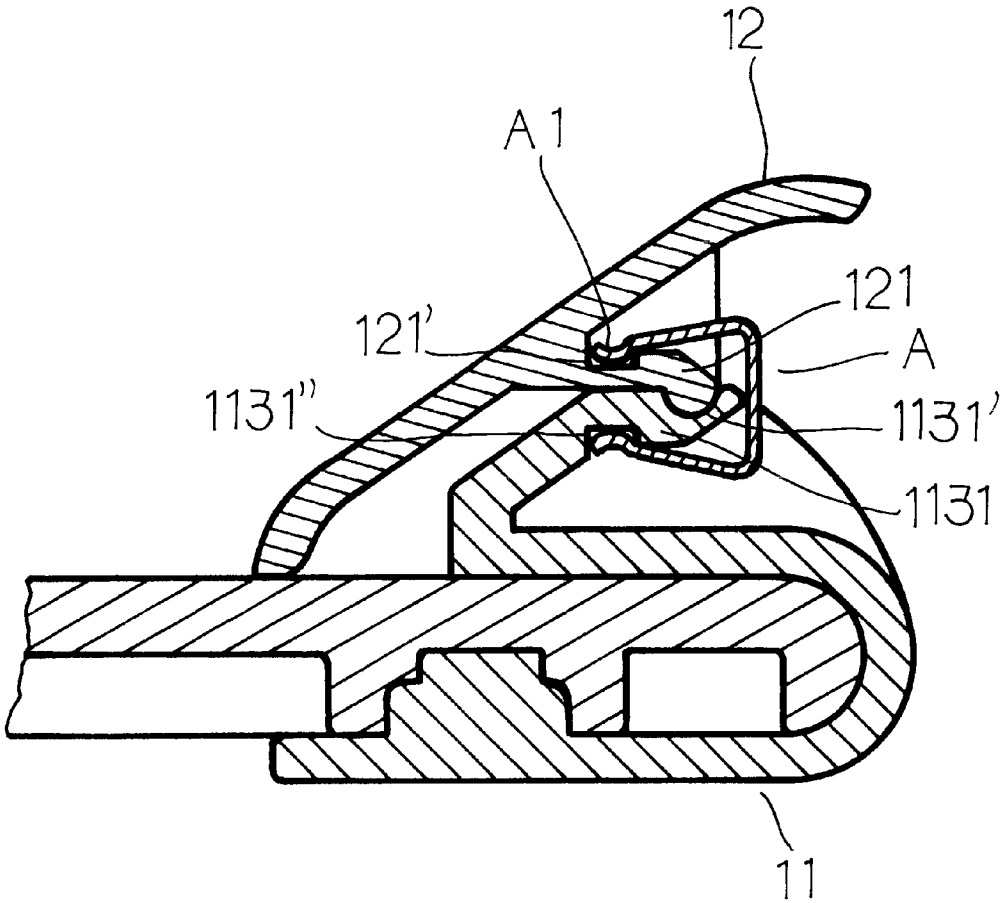
FIG. 5 is a cross-sectional view showing a joint of body, plate member, fastening member at one side of clipboard.

Referring to FIGS. 1 to 5, there is shown a clipboard constructed in accordance with the invention comprising a clip mechanism 1 and a rectangular board mechanism 2. Clip mechanism 1 comprises a flat body 11 having a protrusion 111 near either short side, a projected member 111' on each protrusion 111, two spaced spoon-like members 112 projected between two gaps 112' on a long side, a bent brace 113 on top, two spaced protuberant members 1131 on both sides of brace 113, a first groove 1131' on each protuberant member 1131, a second groove 1131" under each protuberant member 1131, a projection 114 between spoon-like members 112 and under the body 11, an elongate recess 115 adjacent either side of projection 114, and a ridge 115' on each recess 115; a flexible plate member 12 including two spaced projected members 121 on the underside and a groove 121' under each projected member 121; two U-shaped fastening members A each having two hooks A1 on the free ends, hooks A1 clung into grooves 121' and second grooves 1131" for fastening body 11 and plate member 12 so as to hold papers between the plate member 12 and the board mechanism 2; and a retractable hanging device 13 having a J cross-section and comprising an elongate slot 131 on a bottom, two spaced risers 132 adjacent slot 131, a dent 132' on top of each riser 132, and an opening 133 between risers 132.

In assembly, mount hanging device 13 onto body 11 with projection 114 movably received in opening 133 and risers 132 received in recesses 115. When hanging device 13 is not in use, user may retract hanging device 13 to engage with the bent portion of brace 113. Rather, when using hanging device 13, user may pull hanging device 13 to cause it to move a maximum distance equal to a difference between the length of projection 114 and that of opening 133 (see FIG. 1). Also, ridges 115' are received in dents 132'. At this position, hanging device 13 is secured with slot 131 exposed. Hence, an object may be hung on the slot 131.

Board mechanism 2 has a smooth top surface. On the bottom of board mechanism 2, there are provided four channels 21 each parallel to a side 24. A shape of substantially # is formed by four channels 21. Each channel 21 comprises a plurality of equally spaced dents 22. Further, a recessed portion 23 is surrounded by channels 21.

Figure 6:
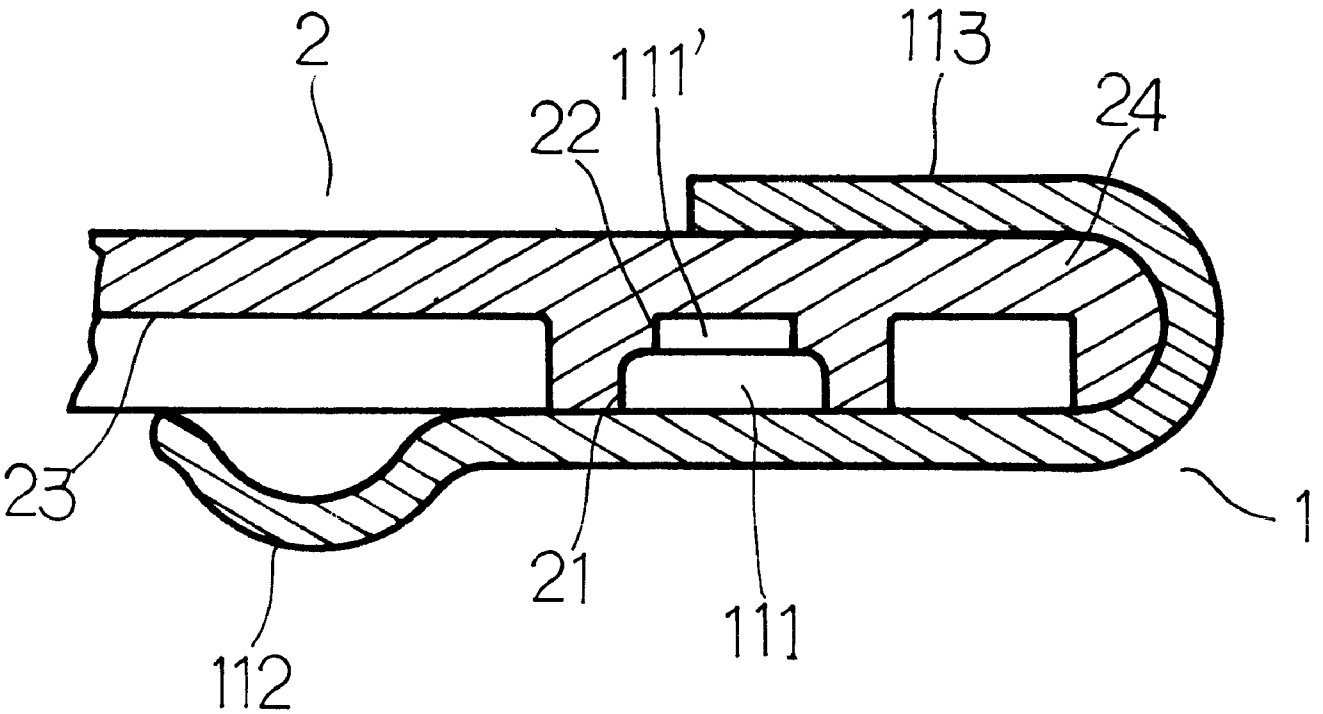
FIG. 6 is a view similar to FIG. 5 showing the provision of means for holding a pen by spoon-like members.
Figure 7:
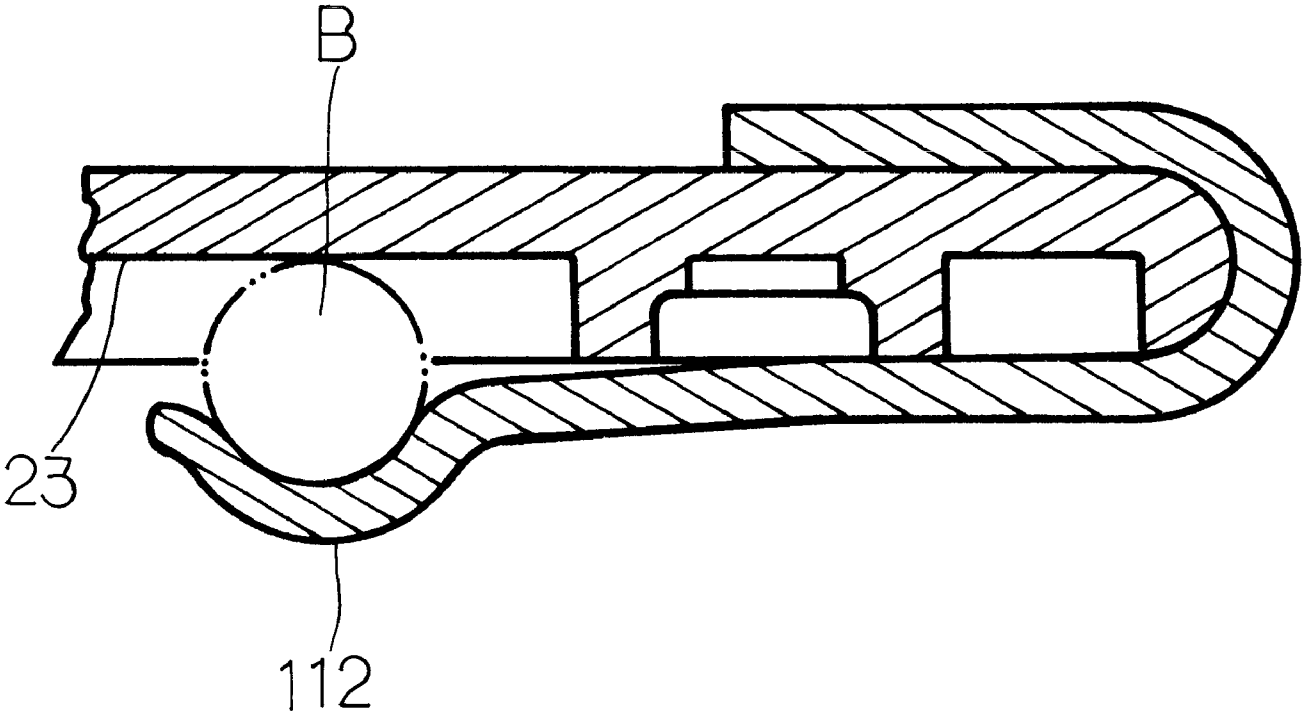
FIG. 7 is a view similar to FIG. 6 showing a pen held by spoon-like members.

Referring to FIGS. 6 and 7, it is possible of mounting body 11, plate member 12, hanging device 13, and fastening members A on one of four sides 24 of board mechanism 2. In mounting, first insert protrusions 111 into channels 21 on one side 24 until projected members 121 receive in dents 22 (i.e., body 11 is secured). Then sequentially mount plate member 12, hanging device 13, and fastening member As. It is also found that a space is formed between spoon-like members 112 and recessed portion 23. Hence, it is possible of inserting a pen B therebetween. The inserted pen B is held firmly between spoon-like members 112 and recessed portion 23 (FIG. 7).

While the invention herein disclosed has been described by means of specific embodiments, numerous modifications and variations could be made thereto by those skilled in the art without departing from the scope and spirit of the invention set forth in the claims.

What is claimed is:

1. A clipboard comprising:

a clip mechanism comprising a body having two spaced protrusions, two projected members each on the protrusion, two spaced spoon-like members projected from a side, a bent brace on a top, two spaced protuberant members on both sides of the brace, two first grooves each on the protuberant member, two second grooves each under the protuberant member, a projection between the spoon-like members and under the body, two spaced elongate recesses on both sides of the projections, and two ridges each on the recess; a flexible plate member including two spaced projected members on an underside and two third grooves each under the projected member; two U-shaped fastening members each having two hooked ends clung into the third groove and second grooves for fastening the body and the plate member for being capable of holding papers; and a retractable hanging device having a J cross-section and comprising an elongate slot on a bottom, two spaced risers adjacent the slot, two first dents each on the riser, and an opening between the risers; and a board mechanism comprising four channels on a bottom each parallel to a side, each channel having a plurality of equally spaced second dents, and a recessed portion surrounded by the channels;

wherein the hanging device is mounted onto the body with the projection movably received in the opening and the risers received in the recesses.

2. The clipboard of claim 1, wherein in an unused state the hanging device is retracted to engage with the brace, and in a use state, the hanging device is extended to move a maximum distance equal to a difference between a length of the projection and that of the opening, the ridges are received in the first dents, and the slot is exposed.

3. The clipboard of claim 1, wherein the protrusions are inserted into the channels on one of the sides of the board mechanism with the projected members received in the second dents.

4. The clipboard of claim 1, wherein a space is formed between the spoon-like members and the recessed portion for holding an elongate object.

* * * * *